US008967030B2

(12) United States Patent
Kister et al.

(10) Patent No.: US 8,967,030 B2
(45) Date of Patent: Mar. 3, 2015

(54) ATTACHMENT DEVICE WITH PYROTECHNIC BOLT

(75) Inventors: Thomas Kister, Vaux sur Siene (FR); Denis Wintersdorff, Aubergenville (FR); Mathieu Davion, Le Pian Medoc (FR)

(73) Assignee: Airbus Defence and Space SAS, Les Mureaux (FR)

( * ) Notice: Subject to any disclaimer, the term of this patent is extended or adjusted under 35 U.S.C. 154(b) by 0 days.

(21) Appl. No.: 13/813,531

(22) PCT Filed: Jul. 27, 2011

(86) PCT No.: PCT/FR2011/051815

§ 371 (c)(1),
(2), (4) Date: Apr. 1, 2013

(87) PCT Pub. No.: WO2012/020191

PCT Pub. Date: Feb. 16, 2012

(65) Prior Publication Data

US 2013/0199359 A1 Aug. 8, 2013

(30) Foreign Application Priority Data

Aug. 10, 2010 (FR) ..... 10 03329

(51) Int. Cl.
*F42B 15/38* (2006.01)

(52) U.S. Cl.
CPC ..... *F42B 15/38* (2013.01)
USPC ..... 89/1.14; 102/378

(58) Field of Classification Search
CPC ..... F42B 3/006
USPC ..... 89/1.14; 102/378
See application file for complete search history.

(56) References Cited

U.S. PATENT DOCUMENTS 7,367,738 B2 * 5/2008 Cleveland ..... 403/31

FOREIGN PATENT DOCUMENTS

| | | |
|---|---|---|
| EP | 0 297 992 A1 | 1/1989 |
| EP | 0 777 101 A1 | 6/1997 |
| EP | 1 355 120 A1 | 10/2003 |

OTHER PUBLICATIONS

International Search Report mailed Oct. 7, 2011, in connection with International Application No. PCT/FR2011/051815, filed Jul. 27, 2011.

* cited by examiner

*Primary Examiner* — Reginald Tillman, Jr.
(74) *Attorney, Agent, or Firm* — Duane Morris LLP; J. Rodman Steele, Jr.; Gregory M. Lefkowitz

(57) ABSTRACT

According to the invention, the device (1) comprises a bolt (6) including a locking member (9) which is mounted such that it can slide with respect to a first component (2) and can adopt a locked position in which the locking member (9) retains the second component (3) and an unlocked position in which the locking member (9) releases the second component (2), the transition from the locked position to the unlocked position taking place under the action of pyrotechnic means (5). In addition, a branch (4) that is at least partially deformable under the action of the pyrotechnic means (5) is arranged with respect to the bolt (6) in such a way that the transition from the locked position to the unlocked position takes place by means of the deformation of said branch (4).

10 Claims, 2 Drawing Sheets

ATTACHMENT DEVICE WITH PYROTECHNIC BOLT

This application is a §371national stage entry of International Application No. PCT/FR2011/051815, filed Jul. 27,2011, which claims priority to French Patent Application No. 1003329 filed Aug. 10,2011, the entire contents of which are Incorporated herein by reference.

The present invention relates to a device for attaching two parts to one another.

The device according to the invention is intended, although not exclusively, for the aviation and aerospace fields in order to allow the connection and then the separation of certain parts of an aircraft or space launcher. For example, a device of this kind may provide the connection between the various parts of the upper structures of a launcher (the nose cone carrying a satellite) and cause, via a command, the separation of said parts.

When two parts between which forces pass must be separated irreversibly and in a short period of time, via a remote control operation, use is frequently made of attachment devices with pyrotechnic rupturing, in which one of the two parts is cut along a given cutting line, in order to separate them from one another. These devices generally include, for that purpose, a pyrotechnic expansion tube with an oblong cross-section, in which runs a detonating fuse that, when lit, produces a shock wave capable of propagating at great speed along the length of the expansion tube in order to deform said tube to the extent of rendering its cross-section substantially circular. For this, the expansion tube is accommodated in a channel with a U-shaped cross-section, made in one of the two parts, this channel being provided with at least one area of reduced thickness, ignition of the detonating fuse then causes at least one of the side pieces forming the U of the channel to break, along lines defined by the areas of reduced thickness.

Attachment devices of this kind have a major disadvantage, insofar as they produce a break in one of the parts, which involves a risk of a fragment being released at the time of the break damaging equipment situated close to the attachment area.

In order to attach two parts to one another, so that they can then be separated without causing one of them to break, it is known from document FR 2 838 818 to use an attachment device provided with a connecting part attached to a first of said parts, comprising a hook-shaped end and a central portion that is at least partially deformable under the action of pyrotechnic means.

The pyrotechnic means have a pyrotechnic expansion tube accommodated in a channel formed, on one side, by the deformable portion of the first part, and on the other by the connecting part. The hook is rigid and disposed in such a way as to hold the second part for as long as the pyrotechnic means are not actuated.

Thus, in this prior document, in order to separate the two parts initially attached to one another, the pyrotechnic means are actuated, which results in the expansion of the expansion tube followed by the deformation of the deformable portion of the connecting part. The hook is then carried in the direction of deformation of the deformable portion and thus releases the second part from the first, without producing a rupture of any kind in one of said parts.

Nevertheless, in an attachment device of this kind, in which a rupture must not be made, it is important to provide a compromise between:

- the mechanical strength of the attachment, which must provide good transmission of mechanical forces between the two parts;

- the weakness of this same attachment, which must permit the connecting part to be deformed in order to easily displace the hook from the position in which it immobilises the second part; and
- the integration and positioning of the connecting part in relation to the two parts.

However, because the connecting part is produced in a single piece, it cannot be both strong and weak, whilst being easy to position relative to the two components to be connected. It follows from this that an attachment device of this kind, equipped with a connecting part made in one piece, cannot provide a satisfactory compromise between these differing requirements.

The aim of the present invention is to remedy these disadvantages and the invention relates to a device for attaching two parts to one another, said device being capable of separating said parts without producing a break of any kind, whilst providing a satisfactory compromise between the ease of assembly, mechanical strength and weakness of the attachment To that end, according to the invention, the device for attaching two parts to one another, said attachment device having a bolt the slider of which is fitted sliding relative to a first of said parts and may adopt:

- a locked position in which said slider retains said second part, and
- an unlocked position in which said slider releases said second part, and the transition from said locked position to said unlocked position is effected under the action of pyrotechnic means, is noteworthy because it comprises a branch at least partly deformable under the action of said pyrotechnic means and arranged relative to said lock in such a way that the transition from said locked position to said unlocked position is effected by deformation of said branch.

Thus, via the invention, the required compromise between mechanical strength and weakness of separation is not made. The invention proposes to dissociate the function of mechanical strength and transmission of forces between the two parts, and the function of triggering the unlocking. More specifically, in the locked position, the slider provides only the function of mechanical strength and transmission of forces between the two parts, while the function of controlling unlocking is provided by the pyrotechnic means, which are capable of causing the bolt to slide into the unlocked position to render the attachment inactive. In this way, insofar as the two main requirements of the device according to the invention—although paradoxical—are fulfilled separately, these two requirements can be met at the same time, in a satisfactory manner, without any compromise being necessary.

Via the invention once again, simple positioning of the attachment device relative to the two parts is facilitated. The slider can, firstly, be fitted easily relative to the first part then, secondly, be connected to the pyrotechnic means—via an additional part if necessary—so that said pyrotechnic means can control the passage of the slider into the locked and unlocked positions, which provides integration and easy positioning of the bolt.

Also via the invention, the rupture of one of the two parts or the use of an additional component is avoided, which prevents a fragment being released during a rupture from damaging equipment situated close to the area where the two parts are attached.

In order to facilitate a controlled deformation of the branch and thus a controlled sliding of the slider, said branch is deformable by pivoting at a portion substantially opposite the lower end of the pyrotechnic means.

According to a first embodiment of the bolt, said bolt has mechanical return means to at least a substantially loaded position, disposed at the slider, between the branch and the first part, in such a way that when said branch is deformed under the action of the pyrotechnic means, said slider slides in the direction of deformation of said branch.

According to a second embodiment of the bolt, said bolt has a mechanical ball joint connection, fixed to the branch and to the end of the slider furthest from the second part, so that when said branch is deformed under the action of the pyrotechnic means, said slider slides in the direction of deformation of said branch.

According to another feature of the invention, the pyrotechnic means comprise a pyrotechnic expansion tube, in which a detonating fuse runs, said tube being accommodated in a channel arranged between the first part and the branch.

According to another feature of the invention, at least a portion of the slider is fitted sliding inside a cavity arranged in the first part, which makes it possible to restrict the number of degrees of freedom of the slider in relation to said first part, said slider being able to move only by a sliding movement, with one degree of freedom, and thus provide the mechanical strength of the attachment between the two parts.

According to another feature of the invention, the slider is arranged, in the locked position, so as to retain a projection provided on the second part, resting against a complementary indentation formed on the first part, which provides effective mechanical attachment of the two parts to one another as long as the pyrotechnic means are not actuated.

The accompanying drawings will give a clear understanding of how the invention may be produced. In these figures, identical reference numerals designate similar elements.

Figure 3:
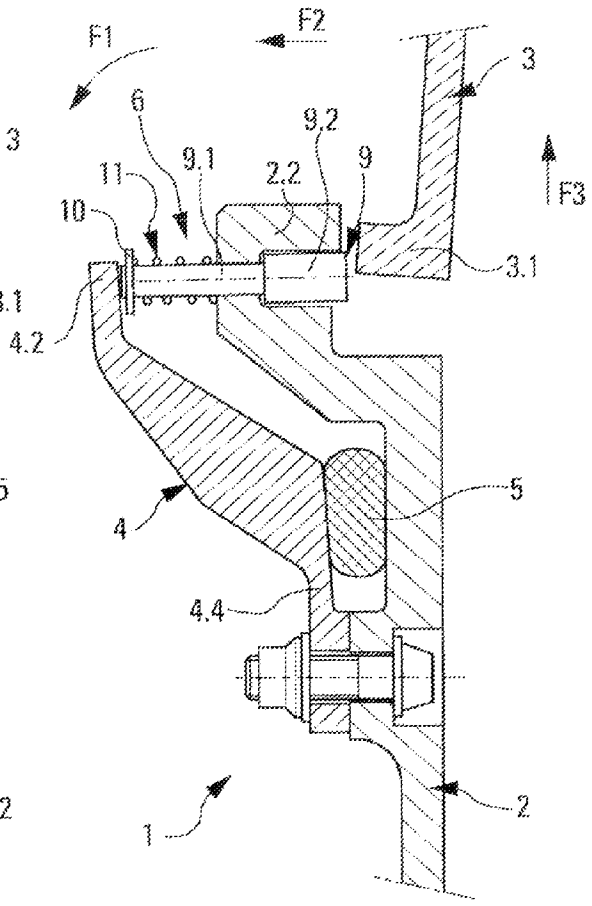
FIG. 3 is a diagrammatic longitudinal cross-section of the attachment device of FIG. 1, the slider of which is in the unlocked position.
Figure 2:
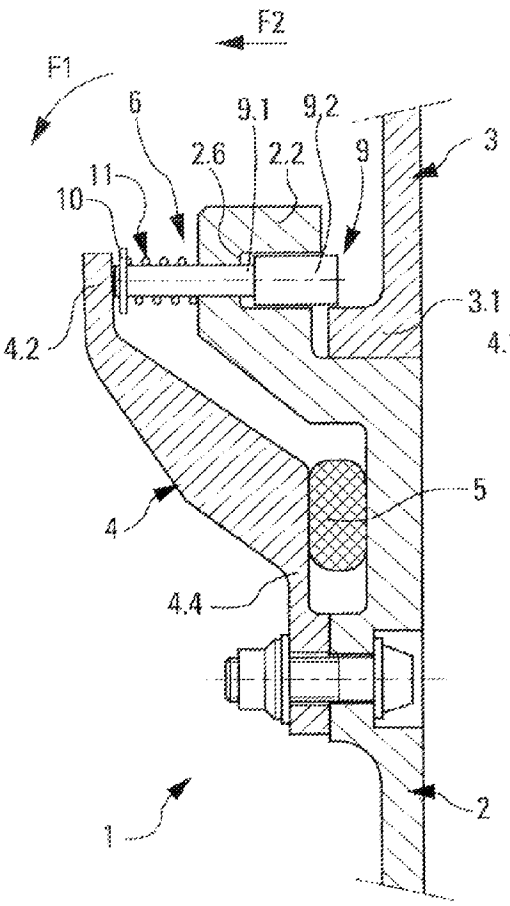
FIG. 2 is a diagrammatic longitudinal cross-section of the attachment device of FIG. 1, during the transition of the slider from the locked position to the unlocked position.
Figure 1:
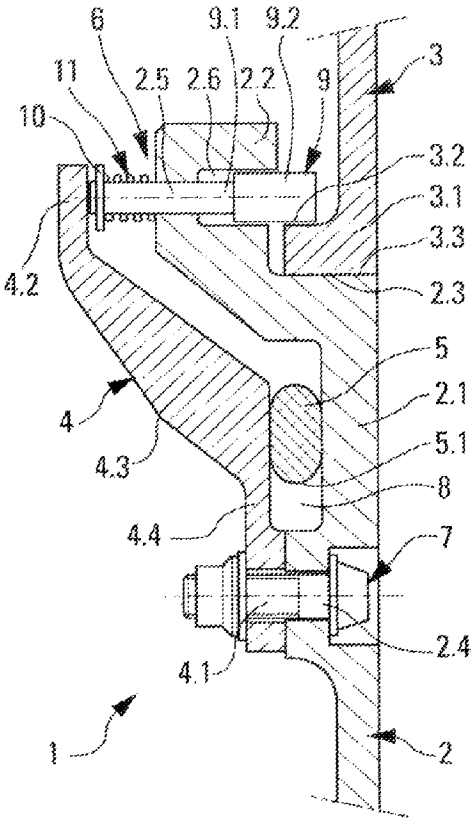
FIG. 1 is a diagrammatic longitudinal cross-section of an attachment device according to a first embodiment of the invention, the slider of which is in the locked position.

The attachment device 1 of FIGS. 1 to 3 is intended to attach the two parts 2 and 3 to one another. For this purpose, it comprises a branch 4, pyrotechnic means 5 and a bolt 6.

The first lower part 2 comprises a first portion 2.1, facing the pyrotechnic means 5, and also a second portion 2.2, above the first portion 2.1 and in the extension thereof, the bolt 6 being fitted in this second portion.

The second upper part 3 comprises a lower portion 3.1 which takes the form of a projection. This projection 3.1 is capable of cooperating with the bolt 6, at its upper surface 3.2

The parts 2 and 3 are intended to rest on one another, at their upper surface 2.3 and lower surface 3.3 respectively, which are complementary in shape. According to another embodiment, the parts 2 and 3 may be placed against one another via an additional part disposed between said parts. When the second part 3 is placed in this way against the first part 2, the upper portion 2.2 of said first part 2 extends beyond the projection 3.1 of said second part 3, in view of the action of the bolt 6.

The branch 4, at least partially deformable, is attached to the first part 2. More specifically, it is attached to the latter via attachment means 7, for example a nut and bolt system passing through holes 4.1 and 2.4 arranged in the branch 4 and the first part 2 respectively.

This branch 4 has:

- a first upper portion 4.2, by which said branch is connected to the bolt 6;
- a second portion 4.3, situated beneath the first portion 4.2, of great thickness (and therefore with high mechanical strength), and of which at least one portion is disposed opposite the pyrotechnic means 5; and
- a third portion 4.4, situated at the lower end 5.1 of the pyrotechnic means 5, of which the thickness (less than that of the second portion 4.3) is low enough for it to be deformed under the action of said pyrotechnic means 5, but also great enough for it not to break under the action of those means 5.

The branch 4 is attached to the first part 2 solely by its lower part, the upper part of said branch 4 being left free in relation to said first part 2 so that these parts can move away from one another under the action of the pyrotechnic means 5.

The pyrotechnic means 5 consist of a pyrotechnic expansion tube 5, of which the cross-section is nominally oblong with fiat sides, in which runs a detonating fuse that can be controlled remotely. This tube 5 is fitted into a channel 8, with a U-shaped cross-section, the two side walls of which are formed respectively by a wall of the portion 2.1 of the first part 2 and by a wall of the thick portion 4.3 of the branch 4. The tube 5 is more specifically placed on a set of localised protrusions (not shown), disposed in the bottom of the channel 8, in order to reduce the shock produced in the structure when the pyrotechnic fuse expands and therefore protect it against the risk of breaking.

It will be noted that among the lateral walls of the channel 8, only the lower portion 4.4 of the branch 4 is of reduced thickness, which makes it the only area mechanically sensitive to any deformation produced by the expansion of the tube 5.

As the pyrotechnic means are disposed in this way, the expansion tube 5 is able to expand when the detonating fuse is actuated, the shape of its cross-section tending to become substantially circular, which has the effect of deforming the branch 4 at the portion 4.4 where its thickness is reduced. The position of this portion 4.4 (at the lower end 5.1 of the pyrotechnic means 5) and the position of the attachment means 7 (beneath the channel 8) causes the branch 4 to pivot around said portion 4.4. Thus, the upper portion of the branch 4—the portions 4.2 and 4.3—moves away from the first part 2.

The bolt 6 consists of a slider 9 comprising a tube 9.1 fitted sliding relative to the first part 2, and more specifically relative to the upper portion 2.2 of this same part, in a hole 2.5 made in this portion. The slider 9 also includes a pin 9.2, of which the cross-section is larger than that of the tube 9.1, disposed at the end portion of said tube 9.1 that is situated on the same side as the second part 3. The pin 9.2 is fitted sliding inside a cavity 2.6 formed in the upper portion 2.2 of the first part 2, in the extension of the hole 2.5 but with a cross-section larger than that of said hole 2.5. The pin 9.2 is partially inserted inside this cavity 2.6, in which it is thus able to slide at the same time as the tube 9.1 inside the hole 2.5.

Disposed in this way, the slider 9 of the bolt 6 is able to move in order to take two positions alternately:

a first locked position in which the pin 9.2 passes above the projection 3.1 and is flush with the upper face 3.2 of said projection, which ensures that the second part 3 is properly attached relative to the first part 2; and a second unlocked position for which, under the action of the pyrotechnic means 5 which cause the deformation of the branch 4, the tube 9.1 and the pin 9.2 slide so that they move away from the second part 3, said pin 9.2 thus being inserted inside the cavity 2.6 until it is no longer flush with the projection 3.1, which has the effect of releasing said second part 3.

It will be noted here that the cavity 2.6 is sufficiently deep that when the pin 9.2 comes into abutment against the base wall of said cavity 2.6, said pin is no longer flush with the upper portion of the projection 3.1 and the second part 3 is released.

In the embodiment shown in FIG. 1, the connection between the branch 4 and the bolt 6 is made by a disc 10, fixed to the end of the tube 9.1 furthest from the second part 3, resting on the upper portion 4.2 of said branch 4. Mechanical return means 11 are furthermore disposed around the tube 9.1, between the disc 10 and the portion 2.2 of the first part 2. When the bolt is in the locked position, the return means 11, for example in the form of a mechanical spring, are in the loaded position. The tube 9.1, which thus rests on the portion 4.2 of the branch 4, is capable of following the movement of said portion 4.2, because when said portion moves away from the two parts 2 and 3, the return means 11 relax and push the disc 10. The return means 11 thus also push the tube 9.1, which therefore continues to rest on the portion 5.2.

It will be noted that the relaxation of the return means 11 is at least equal to the play of the pin 9.2 inside the cavity 2.6, so that when the branch 4 moves away from the second part 3, said pin 9.2 can be inserted sufficiently inside said cavity 2.6, under the effect of the relaxation of the return means 11, until the slider 9 of the bolt 6 is able reach the unlocked position.

If will also be noted that the channel 8 is not closed and extends towards the upper part of the attachment device 1, which ensures that the upper portion of the branch 4 can effectively be deformed by said branch 4 pivoting around the lower portion 4.4.

FIG. 1 shows the case where the slider 9 of the bolt 6 is in the locked position, for as long as the pyrotechnic means 5 are not actuated. The branch 4 is thus not deformed, the mechanical return means 11 are in a compressed position and the pin 9.2 retains the projection 3.1 of the second part 3 against the first part 2.

During the first moments that follow the actuation of the pyrotechnic means 5, as shown in FIG. 2, the slider 9 moves towards the unlocked position. More specifically, under the action of the expansion of the expansion tube 5 (the cross-section of which tends to change from an oblong shape to an substantially circular shape), the upper portion of the branch 4 deforms substantially in the direction of the arrow F1, in other words, in the direction of moving away relative to the second part 3, by pivoting around the thinner area 4.4.

Consequently, the space between the upper portions respectively 4.2 (of the branch 4) and 2.2 (of the first part 2) becomes larger. The return means 11 relax which has the effect of pushing the disc 10—and therefore the tube 9.1—in the direction of the arrow F2 in such a way that said tube 9.1 continues to rest on the portion 4.2. Because of this, the pin 9.2 is drawn in the direction of the arrow F2 and thus penetrates the cavity 2.6.

At this moment, a portion of the pin 9.2 is nevertheless still flush with the upper face of the projection 3.1, which continues to immobilise the second part 3. The slider 9 has therefore not yet completely reached the unlocked position.

A few moments later, as shown in FIG. 3, the slider 9 of the bolt 6 reaches the unlocked position. More specifically, the upper portion of the branch 4 is sufficiently deformed in the direction of the arrow F1 for the pin 9.2 to be completely drawn in the direction of the arrow F2 by the action of the return means 11 which causes the tube 9.1 to occupy the space between the upper portions 4.2 and 2.2 respectively of the branch 4 and the first part 2.

The pin 9.2 then rests on the base wall of the cavity 2.6 and is no longer flush with the projection 3.1. The second part 3 is thus freed by its movements and then moves away from the first part 2, substantially in the direction of the arrow F3.

Afterwards, still under the effect of the expansion of the expansion tube 5 of which the cross-section tends to become substantially circular, the upper portion of the branch 4 is able to deform again in the direction of the arrow F1 by pivoting around its thinner area 4.4, while the pin 9.2 has come into abutment against the base wall of the cavity 2.6. The slider 9 of the bolt 6 can therefore no longer rest on said branch 4.

Thus constituted, the attachment device 1 provides at the same time:

mechanical strength of the attachment between the two parts 2 and 3, for effective transmission of mechanical stress from one to the other, when the slider 9 is in the locked position;

effective separation of the parts 2 and 3 as a result of the action of a pyrotechnic control, via the transition of said slider 9 to the unlocked position, without rupturing one of the parts and, finally easy assembly and positioning of the device 1 relative to said parts 2 and 3.

Figure 6:
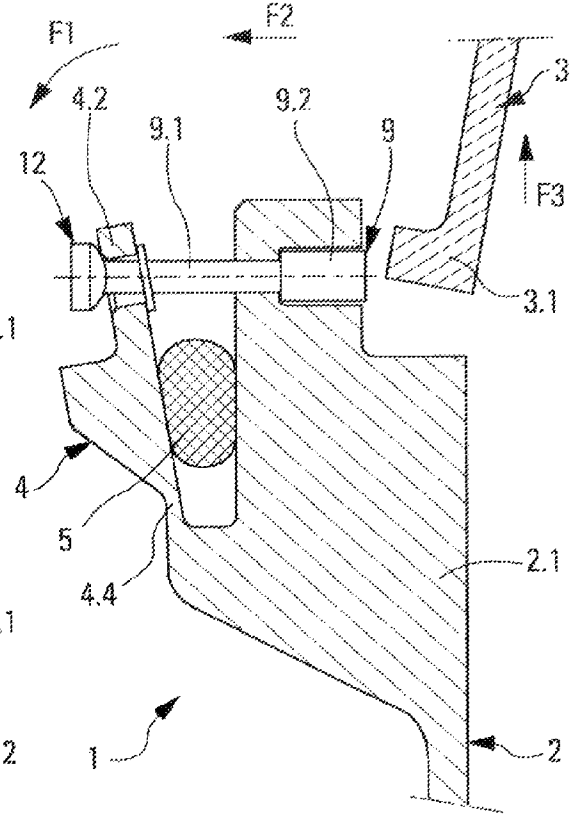
FIG. 6 is a diagrammatic longitudinal cross-section of the attachment device of FIG. 4, the slider of which is in the unlocked position.

An attachment device according to a second embodiment of the invention will now be described, with reference to FIGS. 4 to 6. This attachment device 1 is of a type similar to that of FIGS. 1 to 3, but with two noteworthy differences.

Firstly, the branch 4 is not attached to the first part 2, but forms part thereof. Thus, the channel 8 is delimited, at the place intended for the pyrotechnic means 5, by two side walls originating from the first part 2: the portion 2.1 and the branch 4. In this particular embodiment, it will be noted that the branch 4 still has an upper portion 4.2 connected to the bolt 6, a thick portion 4.3 facing the pyrotechnic means 5 and a thin portion 4.4 just below said pyrotechnic means 5.

Likewise, although the bolt 6 still comprises a slider 9 consisting of a tube 9.1 and a pin 9.2, it also has a mechanical bail joint 12, attached to the upper portion 4.2 of the branch 4, inside a hole 4.5 made in this same portion. This connection 12 is also attached to the end of the tube 9.1 furthest from the second part 3. This mechanical connection makes it possible to adapt the movement of the bolt 6 with regard to the increase in the angular separation between the branch 4 (which deforms by pivoting around the portion 4.4) and the slider 9 (which slides along a fixed axis).

Figure 4:
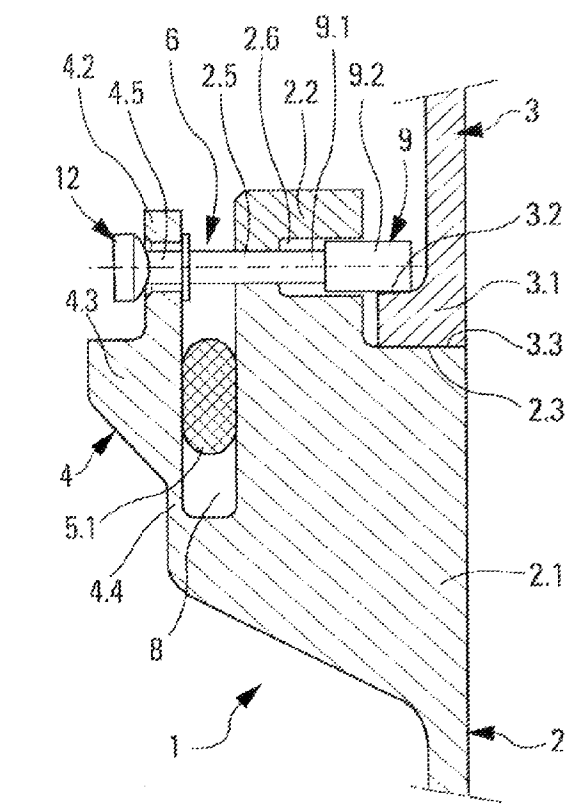
FIG. 4 is a diagrammatic longitudinal cross-section of an attachment device according to a second embodiment of the invention, the slider of which is in the locked position.

Thus, with reference to FIG. 4, as long as the detonating fuse is not actuated, the expansion tube 5 retains its oblong form, the branch 4 is not deformed and the slider 9 of the bolt 6 therefore remains in the locked position, for which the second part 3 is attached to the first 2 by the pin 9.2 which immobilises the projection 3.1.

Figure 5:
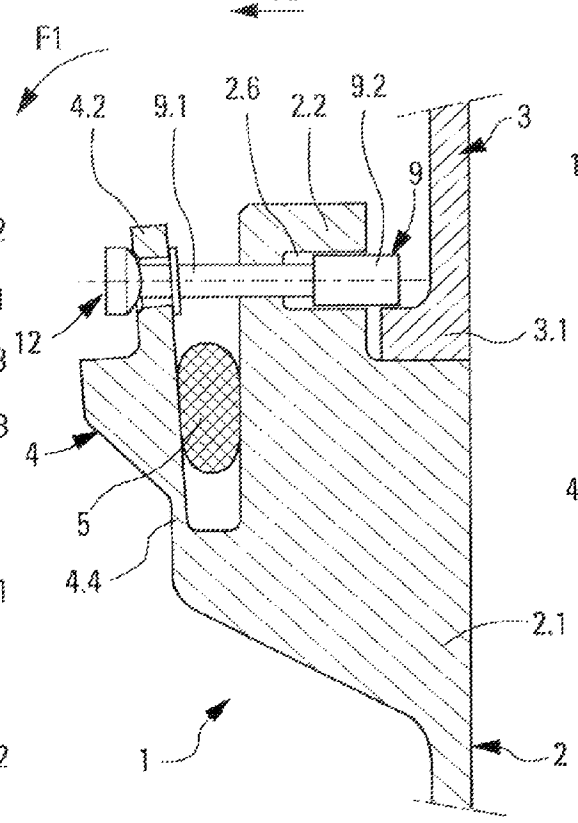
FIG. 5 is a diagrammatic longitudinal cross-section of the attachment device of FIG. 4, during the transition of the slider from the locked position to the unlocked position.

Next, with reference to FIG. 5, when the detonating fuse is actuated, the slider 9 passes progressively from the locked position to the unlocked position. More specifically, the expansion tube 5 expands so that its cross-section becomes substantially circular, which results in the deformation of the branch 4 by pivoting around its thinner portion 4.4, in the direction of the arrow F1. The bail joint 12, attached to the branch 4, then draws towards it (in the direction of the arrow F2) the tube 9.1 and the pin 9.2, said pin penetrating the cavity 2.6. At that moment, a portion of the pin 9.2 is still flush with the upper face of the projection 3.1 of the second part 3, which continues to immobilise said part 3.

A few moments later, with reference to FIG. 6, the slider 9 reaches the unlocked position, the branch 4 being sufficiently deformed in the direction of the arrow F1 so that the pin 9.2 is fully inserted inside the cavity 2.6, by the action of the ball joint 12 which draws the slider 9 whilst compensating for the effects of the angular separation between the branch 4 and said slider 9. The pin 9.2 is therefore no longer flush with the projection 3.1 of the second part 3, which is thus free in its movements and moves away from the first part 2, in substantially the same direction as the arrow F3.

The invention has been described above for two embodiments of the bolt 6, one with mechanical return means and the other with a mechanical ball joint, but it is obvious that a person skilled in the art will be able to produce other variants of the bolt, insofar as said bolt properly enables the slider 9 to be caused to slide under the action of the pyrotechnic means 5, by deformation of the branch 4.

The invention claimed is:

1. Device (1) comprising:

two parts (2,3) releasably attachable to one another, a bolt (6) comprising a slider (9) adapted for fitted sliding relative to a first (2) of said parts (2,3) and adapted to slide between:

a locked position in which said slider (9) retains said second part (3), and an unlocked position in which said slider (9) releases said second part (3), a pyrotechnic expansion tube, and a branch (4) at least partly deformable under action of pyrotechnic expansion tube (5) and arranged relative to said bolt (6) in such a way that the transition from said locked position to said unlocked position is effected by deformation of said branch (4), wherein the bolt (6) comprises a return spring (11) to at least a substantially loaded position, disposed at the slider (9), between the branch (4) and the first part (2), in such a way that when said branch (4) is deformed under the action of the pyrotechnic expansion tube (5), said slider (9) slides in the direction (F1) of deformation of said branch (4).

2. Device according to claim 1, wherein the branch (4) is deformable by pivoting at a portion (4.4) substantially opposite the lower end (5.1) of the pyrotechnic expansion tube (5).

3. Device according to claim 1, wherein the pyrotechnic means (5) comprise a pyrotechnic expansion tube (5), in which runs a detonating fuse, said tube (5) being accommodated in a channel (8) arranged between the first part (2) and the branch (4).

4. Device according to claim 1, wherein at least a portion (9.2) of the slider (9) fits slidably inside a cavity (2.6) arranged in the first part (2).

5. Device according to claim 1, wherein the slider (9) is arranged, in the locked position, so as to retain a projection (3.1) provided on the second part (3), resting on a complementary indentation (2.3) formed on the first part (2).

6. Device (1) comprising:

two parts (2,3) releasably attachable to one another, a bolt (6) comprising a slider (9) adapted for fitted sliding relative to a first (2) of said parts (2,3) and adapted to slide between:

a locked position in which said slider (9) retains said second part (3), and an unlocked position in which said slider (9) releases said second part (3), a pyrotechnic expansion tube, and a branch (4) at least partly deformable under action of pyrotechnic expansion tube (5) and arranged relative to said bolt (6) in such a way that the transition from said locked position to said unlocked position is effected by deformation of said branch (4), wherein the bolt (6) comprises a mechanical ball joint (12), attached to the branch (4) and to the end of the slider (9) furthest from the second part (3), in such a way that when said branch (4) is deformed under the action of the pyrotechnic expansion tube (5), said slider (9) slides in the direction (Fl) of deformation of said branch (4).

7. Device according to claim 6, wherein the branch (4) is deformable by pivoting at a portion (4.4) substantially opposite the lower end (5.1) of the pyrotechnic expansion tube (5).

8. Device according to claim 6, wherein the pyrotechnic means (5) comprise a pyrotechnic expansion tube (5), in which runs a detonating fuse, said tube (5) being accommodated in a channel (8) arranged between the first part (2) and the branch (4).

9. Device according to claim 6, wherein at least a portion (9.2) of the slider (9) fits slidably inside a cavity (2.6) arranged in the first part (2).

10. Device according to claim 6, wherein the slider (9) is arranged, in the locked position, so as to retain a projection (3.1) provided on the second part (3), resting on a complementary indentation (2.3) formed on the first part (2).

* * * * *